US011622188B1

(12) United States Patent
Perrin

(10) Patent No.: US 11,622,188 B1
(45) Date of Patent: Apr. 4, 2023

(54) HEADPHONE INDICATOR

(71) Applicant: Joel Perrin, Duluth, MN (US)

(72) Inventor: Joel Perrin, Duluth, MN (US)

( * ) Notice: Subject to any disclaimer, the term of this patent is extended or adjusted under 35 U.S.C. 154(b) by 0 days.

(21) Appl. No.: 17/869,365

(22) Filed: Jul. 20, 2022

Related U.S. Application Data

(60) Provisional application No. 63/350,546, filed on Jun. 9, 2022.

(51) Int. Cl.
*H04R 1/10* (2006.01)
*H04R 29/00* (2006.01)

(52) U.S. Cl.
CPC ..... *H04R 1/1091* (2013.01); *H04R 1/1016* (2013.01); *H04R 1/1041* (2013.01); *H04R 29/008* (2013.01)

(58) Field of Classification Search
CPC ... H04R 1/1091; H04R 1/1016; H04R 1/1041
See application file for complete search history.

(56) References Cited

U.S. PATENT DOCUMENTS

2004/0185915 A1* 9/2004 Ihara ..... H04M 1/6066 455/569.1
2016/0029114 A1* 1/2016 Chen ..... H04W 4/80 381/74
2021/0152910 A1* 5/2021 Llewelyn ..... H04L 51/046
2021/0409534 A1* 12/2021 Kuzhiyil ..... H04M 1/72442

* cited by examiner

*Primary Examiner* — Simon King
(74) *Attorney, Agent, or Firm* — Fredrikson & Byron, P.A.

(57) ABSTRACT

An earbud device includes a visual indicator mechanism at a body of the earbud device, a receiver at the body of the earbud device, and a speaker at the body of the earbud device. The receiver is configured to receive an audio signal from a mobile device when the earbud device is in communication with the mobile device. The speaker is configured to output audio corresponding to the received audio signal from the mobile device. The visual indicator mechanism is configured to output at least one visual indication when the earbud device is in use. The visual indication output by the visual indicator mechanism can be a first visual indication output from the visual indicator mechanism corresponding to a first preset earbud use type and/or a second, different visual indication output from the visual indicator mechanism corresponding to a second, different preset earbud use type.

17 Claims, 3 Drawing Sheets

HEADPHONE INDICATOR

RELATED APPLICATION

This application claims priority to U.S. provisional patent application No. 63/350,546, filed on Jun. 9, 2022, the contents of which are hereby incorporated by reference.

TECHNICAL FIELD

This disclosure relates generally to a headphone or earbud device having an indicator mechanism that is configured to output an indication relating to a use status of the earbud device. Certain embodiments include an earbud device having the indicator mechanism that is configured to output a visual indication that corresponds to a preset type of use of the earbud device, such as a first visual indication output from the indicator mechanism corresponding to a first preset earbud use type and a second, different visual indication output from the indicator mechanism corresponding to a second, different preset earbud use type.

BACKGROUND

Headphones or earbuds are used to convey audio directly into the ear of a wearer. The use of earbuds has increased over the years, as the use of portable audio devices, including mobile devices, has increased. Given the variety of portable audio devices and the variety of audio use cases for earbuds, it can be difficult for an observer to discern whether an earbud wearer is using the earbud for a task that would be discourteous to interrupt. It can even be difficult for an observer to discern whether an earbud wearer is using the earbud at all, given an earbud wearer oftentimes will wear the earbud despite not having any audio output at that time, for instance in anticipation of a potential phone call. Thus, it can be difficult for an observer to discern whether an earbud wearer is, for instance, using the earbud for an active phone call, and thus it could be discourteous for the observer to interrupt the wearer at that time, or instead that the wearer is currently inactive on the earbud (e.g., not currently using the earbud) or using the earbud to listen to music, and thus it could be fine for the observer to interrupt the wearer at that time.

SUMMARY

Certain embodiments disclosed herein relate to a headphone or earbud device having an indicator mechanism that is configured to output an indication (e.g., visual indication, haptic indication, and/or audio indication) relating to a use status and/or state of the earbud device. The inclusion of such an indicator mechanism at an earbud device can provide a number of useful advantages. For instance, the indicator mechanism can simply and easily convey to an observer of the earbud device wearer a current use status of the earbud device. This can allow the observer to discern whether the earbud device wearer is currently using the earbud device for a type of use case that could be discourteous to interrupt (e.g., on an active phone call) or, instead, that the earbud device wearer is either not currently using the earbud device or is using the earbud device for a type of use case that could be more appropriate to interrupt (e.g., listening to music). Accordingly, earbud device embodiments disclosed herein can provide an alert to an observer of an earbud device wearer as to whether the earbud device wearer is currently using the earbud for a use that would be undesirable for interruption at the current time. This can provide the earbud device wearer with the convenience of not being interrupted at a non-ideal earbud use time and help to reduce instances of an observer being overheard at the earbud device. In embodiments where the indicator mechanism can output an indication relating to a state (e.g., lost earbud, located beyond a predetermined distance from a mobile device, battery power below a predetermined level) of the earbud device, the indicator mechanism can be useful for conveying earbud device state information to a user that may help to inform a future action to be taken with respect to the earbud device (e.g., need to charge earbud device battery, need to bring earbud device and mobile device back within range of one another to establish audio signal communication).

Certain such embodiments include an earbud device having a visual indicator mechanism that is configured to output a visual indication that corresponds to a preset type of use of the earbud device. As one particular such example, the visual indicator mechanism at the earbud device can be configured to output a first visual indication output from the visual indicator mechanism corresponding to a first preset earbud use type and/or a second, different visual indication output from the visual indicator mechanism corresponding to a second, different preset earbud use type.

One embodiment includes an earbud device. This earbud device embodiment includes a visual indicator mechanism at the earbud device (e.g., at a body of the earbud device), a receiver (e.g., a wireless receiver or a wireless transceiver), and a speaker. The receiver is configured to receive an audio signal from a mobile device when the earbud device is in communication with the mobile device (e.g., when the earbud device is paired with the mobile device). The speaker is configured to output audio corresponding to the received audio signal from the mobile device. The visual indicator mechanism is configured to output at least one visual indication when the earbud device is in use.

In a further embodiment of this earbud device, the visual indicator mechanism is configured to output a first visual indication output from the visual indicator mechanism corresponding to a first preset earbud use type and/or a second, different visual indication output from the visual indicator mechanism corresponding to a second, different preset earbud use type. For example, the first preset earbud use type can one be selected from the group consisting of: incoming phone call; on an active phone call; non-phone call audio playing (e.g., recorded audio file, streaming audio, etc.); and inactive earbud. And, for example, the second preset earbud use type can be another, different one selected from the group consisting of: incoming phone call; on an active phone call; non-phone call audio playing; and inactive earbud. For example, the first visual indication output from the visual indicator mechanism can be one selected from the group consisting of: a first color (e.g., red); a second different color (e.g., blue); a first light emission pattern (e.g., steady light emission); and a second different light emission pattern (e.g., flashing light emission). And, for example, the second visual indication output from the visual indicator mechanism can be another, different one selected from the group consisting of: a first color (e.g., red); a second different color (e.g., blue); a first light emission pattern (e.g., steady light emission); and a second different light emission pattern (e.g., flashing light emission).

In a further embodiment of this earbud device, the visual indicator mechanism at the earbud device is configured to emit a visual indication, corresponding to a preset type of signal from the mobile device, when the earbud device is not being worn by a wearer. For example, when the earbud device is not being worn by a wearer, the visual indicator mechanism at the earbud device can be configured to emit the visual indication (e.g., a flashing first color) corresponding to an incoming phone call as the preset type of signal from the mobile device.

In a further embodiment of this earbud device, the visual indicator mechanism is configured to output a first visual indication, at the visual indicator mechanism, corresponding to a first preset earbud use type. The first preset earbud use type can include receiving the audio signal from the mobile device, and the visual indicator mechanism can be configured to output a second, different visual indication, at the visual indicator mechanism, corresponding to a second, different preset earbud use type. For example, the first preset earbud use type can include use of the earbud device for an active phone call via the mobile device, and the second preset earbud use type can include at least one of: an audio inactive earbud and use of the earbud device for non-phone call audio playing. As another example, the first preset earbud use type can be selected from the group consisting of: incoming phone call; on an active phone call; non-phone call audio playing; and inactive earbud. For instance, the second preset earbud use type can be another, different selection from the group consisting of: incoming phone call; on an active phone call; non-phone call audio playing; and inactive earbud. And, the first visual indication output from the visual indicator mechanism can be selected from the group consisting of: a first color; a second different color; a first light emission pattern; and a second different light emission pattern; and the second visual indication output from the visual indicator mechanism can be another, different selection from the group consisting of: a first color; a second different color; a first light emission pattern; and a second different light emission pattern. In some such embodiments, the first visual indication output from the visual indicator mechanism can be a first color at a first light emission pattern, and the second visual indication output from the visual indicator mechanism is a second, different color at a second, different light emission pattern. Likewise, in some such embodiments, the first visual indication output from the visual indicator mechanism can be a first light emission pattern, and the second visual indication output from the visual indicator mechanism can be a second, different light emission pattern. In one instance, the first visual indication output from the visual indicator mechanism can be one of a first color and a second different color, and the second visual indication output from the visual indicator mechanism can be one of a first light emission pattern and a second, different light emission pattern. In another instance, the first visual indication includes at least one of a first color and a first light emission pattern and the first preset earbud use type includes use of the earbud device for an active phone call via the mobile device, and the second visual indication includes at least one of a second, different color and a second, different light emission pattern and the second preset earbud use type is selected from the group consisting of: an incoming phone call; non-phone call audio playing; and inactive earbud.

In some such earbud device embodiments, the earbud device can be configured to receive, at the receiver, an enabled/disabled signal from the mobile device in communication with the receiver, and, in response to receiving the enabled/disabled signal from the mobile device, the processing circuitry of the earbud device can be configured to correspondingly enable/disable the visual indicator mechanism at the earbud device.

In a further embodiment this earbud device, the receiver can be included as part of a wireless transceiver at the earbud device.

In a further embodiment of this earbud device, the receiver can be configured to receive an audio signal from a mobile device when the earbud device is in signal communication with the mobile device. And, the visual indictor mechanism can be configured to change the at least one visual indication output at the visual indicator mechanism when the receiver receives the audio signal from the mobile device. Also, the speaker can be configured to output audio at the earbud device corresponding to the received audio signal from the mobile device, and the visual indictor mechanism can be configured to maintain the at least one visual indication output at the visual indicator mechanism when the speaker outputs the audio signal from the mobile device.

Another embodiment includes a method. This method embodiment includes the steps of receiving a phone call at a mobile device, and, when the phone call is active at the mobile device, outputting a first visual indication at a visual indicator mechanism that is included at a body of an earbud device. The earbud device is in audio signal communication with the mobile device. And, this method embodiment includes the step of, when the phone call ends at the mobile device, terminating the first visual indication at the visual indication mechanism at the earbud device.

In a further embodiment of this method, the method additionally includes the step of, when the earbud device is receiving non-phone call audio from the mobile device, outputting a second, different visual indication at the visual indicator mechanism that is included at a body of an earbud device. As one example, the first visual indication and the second, different visual indication can include different light states selected from the group consisting of: a first color; a second, different color; a first light pattern; and a second, different light pattern.

In a further embodiment of this method, the method additionally includes the step of, when the earbud device is in audio signal communication with the mobile device and the earbud device is separated from the mobile device by more than a predetermined distance, outputting an earbud device separation alert (e.g., audio and/or visual) at the mobile device. In another alternative or additional embodiment, the method can include the step of, when the earbud device is in audio signal communication with the mobile device and the earbud device is separated from the mobile device such that the earbud device loses audio signal communication with the mobile device, outputting an earbud device separation alert (e.g., audio and/or visual) at one or both of the earbud device and the mobile device.

In a further embodiment of this method, the method additionally includes the step of, when the mobile device is receiving the phone call but the phone call is not yet active at the mobile device, outputting a second, different visual indication at the visual indicator mechanism that is included at a body of an earbud device.

The details of one or more examples of the disclosure are set forth in the accompanying drawings and the description below. Other features, objects, and advantages of the disclosure will be apparent from the description and drawings, and from the claims.

BRIEF DESCRIPTION OF DRAWINGS

The following drawings are illustrative of particular examples of the present invention and therefore do not limit the scope of the invention. The drawings are not necessarily to scale, though embodiments can include the scale illustrated, and are intended for use in conjunction with the explanations in the following detailed description wherein like reference characters denote like elements. Examples of the present invention will hereinafter be described in conjunction with the appended drawings.

DETAILED DESCRIPTION

The following detailed description is exemplary in nature and is not intended to limit the scope, applicability, or configuration of the invention in any way. Rather, the following description provides some practical illustrations for implementing examples of the present invention. Those skilled in the art will recognize that many of the noted examples have a variety of suitable alternatives.

Figure 1:
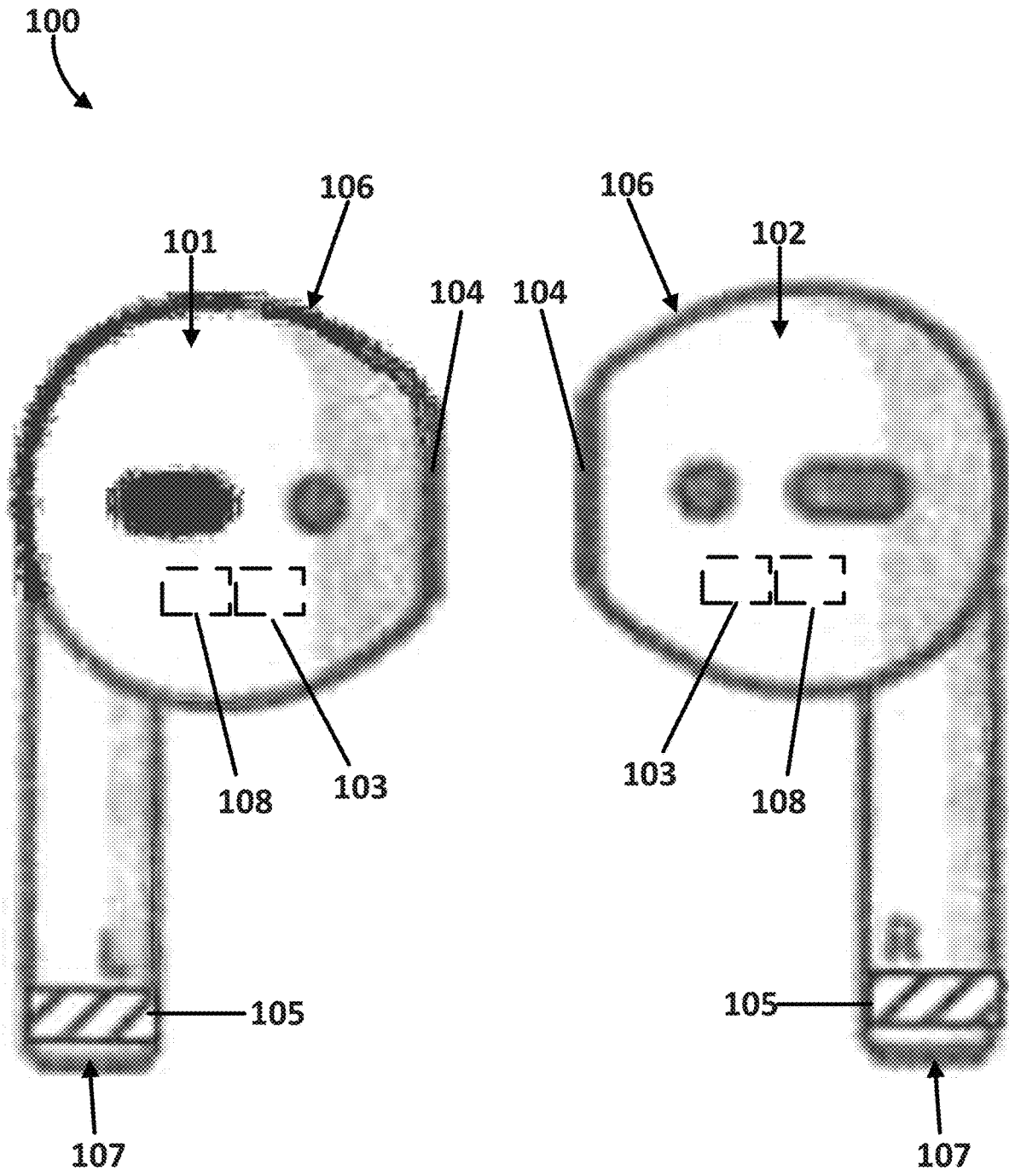
FIG. 1 is an elevational view illustrating an exemplary embodiment of a pair of earbud devices, in accordance with one or more embodiments described herein.

FIG. 1 illustrates an elevational view of an embodiment of a pair of earbud devices 100. It is to be noted that the details disclosed herein could equally be applied to a headphone device. The pair of earbud devices 100 includes an embodiment of a first earbud device 101 and an embodiment of a second earbud device 102. Each earbud device 101, 102 can be in communication (e.g., wireless communication, such as via Bluetooth) with a mobile device, such as a mobile phone or other type of mobile computing device. Each earbud device 101, 102 can include a body 106, a receiver 103 (e.g., a wireless receiver or a wireless transceiver) at the body 106, a speaker 104 at the body 106, and a visual indicator mechanism 105 at the body 106. Each earbud device 101, 102 can also include processing circuitry 108 at the body 106, and each of the receiver 103, speaker 104, and visual indicator mechanism 105 can be coupled to the processing circuitry 108. Processing circuitry 108 (e.g., programmable processing circuitry) can, in some examples, include a non-transitory computer-readable storage article that stores computer executable instructions that can be executed by the processing circuitry 108 to carry out a corresponding function, such as any one or more of the functions associated with the earbud device 101, 102 disclosed herein. In some embodiments, each earbud device 101, 102 can additionally include a microphone 107 at the body 106, and, when the microphone 107 is included, the microphone 107 can be coupled to the processing circuitry 108. The receiver 103 can be configured to receive an audio signal from the mobile device when the earbud device 101, 102 is in communication with the mobile device (e.g., when the earbud device 101, 102 is paired with the mobile device for audio signal communication between the mobile device and the earbud device 101, 102). The speaker 104 can be configured to output audio corresponding to the received audio signal from the mobile device (e.g., an audio signal received at the receiver 103). The visual indicator mechanism 105 can be configured to output at least one visual indication when the respective earbud device 101, 102 is in use. And, when included at the earbud device 101, 102, the microphone 107 can be configured to receive audio from the earbud wearer. When the microphone 107 is included at the earbud device 101, 102, the earbud device 101, 102 can include a transmitter (e.g., a wireless transmitter; a wireless transceiver that include both a wireless transmitter component and a wireless receiver component), and such transmitter can convey an audio signal, corresponding to the audio from the earbud wearer received at the microphone 107, to the mobile device that is in communication with the earbud device 101, 102.

The visual indicator mechanism 105 can be configured to output one or more various types of visual indicators. As one example, the visual indicator mechanism 105 can include one or more light emitting elements at the body 106 of the respective earbud device 101, 102. As one such specific example, the visual indicator mechanism 105 can include one or more light emitting diodes, for instance a plurality of light emitting diodes, configured to emit two or more different colors. In some such examples, the visual indicator mechanism 105 can include one or more light emitting elements arranged in the form of a light emitting band located at the body 106 of the respective earbud device 101, 102. In certain embodiments, one or more optical components can be included at the visual indicator mechanism 105. For example, a lens could be included at the visual indicator mechanism 105, such as a lens adjacent one or more of the light emitting elements of the visual indicator mechanism 105, to help focus light emitted from the one or more light emitting elements of the visual indicator mechanism 105. In addition or alternative to inclusion of the lens at the visual indicator mechanism 105, the visual indicator mechanism 105 can include a mirror to help magnify and directionally orient light emitted from the one or more light emitting elements of the visual indicator mechanism 105.

The visual indicator mechanism 105 can be configured to output one or more types of visual indications that correspond to one or more preset types of use of the respective earbud device 101, 102. As one particular example, the visual indicator mechanism 105 can be configured to output a first visual indication output, from the visual indicator mechanism 105, corresponding to a first preset earbud use type of the respective earbud device 101, 102 and/or a second, different visual indication output, from the visual indicator mechanism 105, corresponding to a second, different preset earbud use type of the respective earbud device 101, 102. In this way, the visual indication output from the visual indicator mechanism 105 can be useful in conveying to an observer a current use type of the earbud device 101, 102.

For example, the first preset earbud use type of the respective earbud device 101, 102 can one be selected from the group consisting of: incoming phone call; on an active phone call; non-phone call audio playing; and inactive earbud. And, for example, the second preset earbud use type of the respective earbud device 101, 102 can be another, different one selected from the group consisting of: incoming phone call; on an active phone call; non-phone call audio playing; and inactive earbud. For instance, if the earbud 101 is being actively used for a phone call (e.g., phone call audio is currently being output at the speaker 104 of the earbud device 101 and/or phone call audio is currently being received at the microphone 107 of the earbud device 101), the visual indicator mechanism 105 can output the first visual indication output, and, if the earbud 101 is being used for non-phone call audio output (e.g., playing music, playing a podcast, etc.), the visual indicator mechanism 105 can output the second, different visual indication output. In another instance, if the earbud 101 is being actively used for a phone call (e.g., phone call audio is currently being output at the speaker 104 of the earbud device 101 and/or phone call audio is currently being received at the microphone 107 of the earbud device 101), the visual indicator mechanism 105 can output the first visual indication output, and, if the mobile device associated with the earbud 101 has an incoming phone call, the visual indicator mechanism 105 can output the second, different visual indication output.

In some embodiments, the visual indicator mechanism 105 can output the first visual indication and/or second visual indication upon the occurrence of any one or more of the following: earbud device idle and powered on; earbud device idle and powered off (e.g., earbud device will not connect to mobile device until earbud device is powered on); incoming phone call; active phone call in progress; earbud device active but not located at a user's ear; earbud device audio signal communication with mobile device is lost but earbud device is within audio signal communication range of mobile device; earbud device audio signal communication with mobile device is lost and earbud device is outside of audio signal communication range of mobile device; and earbud device battery power is below a predetermined threshold (e.g., low battery power at earbud device). For instance, the visual indicator mechanism 105 can be configured to output a different visual indication for each of the one or more different listed occurrences such that each different occurrence corresponds to a different type of visual indication output at the visual indicator mechanism 105.

Various types of visual indication outputs can be emitted at the visual indicator mechanism 105. Visual indication outputs from the visual indicator mechanism 105 can include one or more different types of light states. Light states can include two or more different colors, such as a first light state including a first color and a second, different light state including a second, different color and/or two or more different light emission patterns, such as a first light state including a steady, or constant, light emission and a second, different light state including a flashing light emission. For example, the first visual indication output from the visual indicator mechanism 105 can be one selected from the group consisting of: a first color (e.g., red); a second different color (e.g., blue); a first light emission pattern (e.g., steady light emission); and a second different light emission pattern (e.g., flashing light emission). And, for example, the second visual indication output from the visual indicator mechanism 105 can be another, different one selected from the group consisting of: a first color (e.g., red); a second different color (e.g., blue); a first light emission pattern (e.g., steady light emission); and a second different light emission pattern (e.g., flashing light emission). In some cases, the first visual indication output from the visual indicator mechanism 105 can be a first light state that includes a first color and a first light emission pattern and the second, different visual indication output from the visual indicator mechanism 105 can be a second, different light state that includes a second, different color and a second, different light emission pattern.

In some embodiments, the earbud device 101, 102 can be configured to receive, at the receiver 103, an enabled/disabled signal from the mobile device that the earbud device 101, 102 is in signal communication with. And, in such embodiments, in response to receiving this enabled/disabled signal from the mobile device, the earbud device 101, 102 can be configured to correspondingly enable/disable the visual indicator mechanism 105. This feature can be useful in allowing a user/wearer of the earbud device 101, 102 to selectively enable/disable visual indication outputs from the visual indicator mechanism 105 at desired times and/or when the earbud devices 101, 102 are in used in certain environments.

In some cases, the visual indicator mechanism 105 of the respective earbud device 101, 102 can be configured to emit a visual indication, corresponding to a preset type of signal from the mobile device, such as any one or more of those visual indications disclosed previously herein, when the earbud device 101, 102 is not being worn by a user. For example, when the earbud device 101, 102 is not being worn by a user, the visual indicator mechanism 105 at the earbud device 101, 102 can be configured to emit the visual indication (e.g., a first light state, such as a flashing first color) corresponding to an incoming phone call as the preset type of signal from the mobile device, even though the earbud device 101, 102 may not be worn by a user at the time the incoming phone call is received at the associated, or paired, mobile device. This can be useful in alerting a user, who is within eyesight of the earbud device 101 and/or 102, that a phone call is incoming even though the user may be away from his or her phone and not wearing the earbud devices 101, 102.

Figure 2:
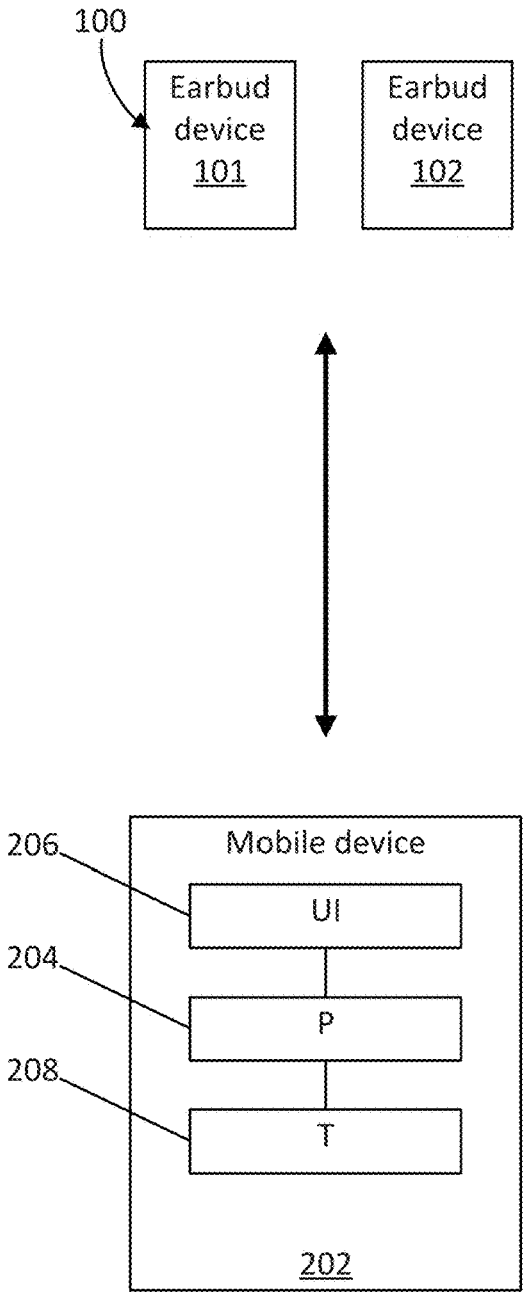
FIG. 2 is a schematic diagram of an embodiment of a system that includes the pair of earbud devices of FIG. 1 and a mobile device, in accordance with one or more embodiments described herein.

FIG. 2 is a schematic diagram of an embodiment of a system 200 that includes the pair 100 of earbud device 101, 102 (e.g., as illustrated and disclosed with respect to FIG. 1) and a mobile device 202. As noted, the earbud device 101, 102 can be in signal communication (e.g., wirelessly, such as via Bluetooth signal communication) with the mobile device 202 such that data is communicated from the mobile device 202 to the earbud device 101, 102 and, in some cases, from the earbud device 101, 102 to the mobile device 202.

The mobile device 202 can include programmable processing circuitry (e.g., a programmable processor) 204, user interface 206 coupled to programmable processing circuitry 204, and transmitter (e.g., wireless transceiver) 208 coupled to programmable processing circuitry 204. Processing circuitry 204 can, in some examples, include a non-transitory computer-readable storage article that stores computer-executable instructions that, when executed by the processing circuitry 204, cause the processing circuitry 204 to carry out a corresponding function. As one example, when computer-executable instructions stored at the mobile device 202 are executed by processing circuitry 204, processing circuitry 204 can cause data (e.g., audio) to be transmitted from mobile device 202 to earbud device 101, 102. As another example, when computer-executable instructions stored at the mobile device 202 are executed by processing circuitry 204, processing circuitry 204 can cause a function to be carried at the mobile device 202 corresponding to a user input received at the user interface 206.

As one more specific example, when computer-executable instructions stored at the mobile device 202 are executed by processing circuitry 204, processing circuitry 204 can cause an earbud device setting, at earbud device 101, 102, to be adjusted corresponding to earbud device setting user input received at the user interface 206. In one such embodiment, processing circuitry 204 can cause the user interface 206 at mobile device 202 to display one or more earbud device settings that include a light state setting for the visual indicator mechanism at the earbud device 101, 102. A user can provide an earbud device setting adjustment input at the user interface 206 to cause a light state output at the visual indicator mechanism to be adjusted corresponding to the earbud device setting adjustment input provided at the user interface 206. The processing circuitry 204 can then cause a setting adjustment command to be sent, via the transmitter 208, to earbud device 101 and/or 102.

For instance, the earbud device setting adjustment input provided by the user at the user interface 206 could be an input to change the preset light state output, associated with a first type of earbud device use case (e.g., on an active phone call), by the visual indicator mechanism at the earbud device 101 and/or 102 from a first light state to a second, different light state when the earbud device 101 and/or 102 is being used for that associated first type of earbud device use case (e.g., on an active phone call). Where the first light state is a first color and/or a first light pattern preset as corresponding to use of the earbud device 101 and/or 102 for the first type of earbud device use case, for instance, the processing circuitry 204 can be configured to receive, via the user interface 206, an earbud device setting adjustment input provided by the user to change the first light state to a second, different light state that include a second, different color and/or a second, different light pattern. This second, different light state can then be stored as the preset visual indication to be output by the visual indicator mechanism at the earbud device 101 and/or 102 when that earbud device 101 and/or 102 is used for the first type of earbud device use case. In one embodiment, the processing circuitry 204 can be configured to display, at the user interface 206, a color gradient (e.g., color gradient bar) and the user input can select a particular color on that displayed color gradient to include as output at the visual indicator mechanism when the earbud device 101 and/or 102 is used for the corresponding earbud device use case. Thus, the processing circuitry 204 can be configured to allow for user input at the mobile device 202 to change a preset light state that is to be output by the visual indicator mechanism at the earbud device 101 and/or 102 when that earbud device 101 and/or 102 is used for a type of preset earbud device use case (e.g., on an active phone call) corresponding to the preset light state.

In certain embodiments, when the earbud device 101, 102 is in signal communication with the mobile device 202, processing circuitry 204 can monitor a general distance between the mobile device 202 and the earbud device 101, 102. In doing so, for example, when the earbud device 101, 102 is in signal communication (e.g., audio signal communication) with the mobile device 202 and the earbud device 101, 102 is separated from the mobile device 202 by more than a predetermined distance, the processing circuitry 204 can cause the mobile device 202 to output an earbud device separation alert (e.g., audible alert and/or visual alert at the mobile device 202, such as via the user interface 206). As one example, the predetermined distance can correspond to a distance between the earbud device 101, 102 and the mobile phone typically indicating that the earbud device 101, 102 has been left behind relative to the mobile device 202 (e.g., the earbud device 101, 102 fell out of the wearer's ear but the mobile device 202 continues to move further away from the earbud device 101, 102). Outputting the earbud device separation alert at the mobile device can be useful, for example, in alerting a user as to a potential misplaced earbud device (e.g., an earbud device that fell out of the user's ear).

As a further example that can be implemented in certain embodiments, the visual indicator mechanism 105 at the earbud device 101, 102 can be disabled (e.g., automatically disabled) as a result of triggering condition at the mobile device 202. For instance, the triggering condition at the mobile device 202 can include the mobile device 202 being located in an automobile, and, in response to the mobile device 202 being located in the automobile, the mobile device 202 (e.g., via the programmable processing circuitry) can send a command signal to the earbud device 101, 102 to cause the earbud device 101, 102 to disable the visual indicator mechanism 105. This disabling of the visual indicator mechanism 105 as a result of the triggering condition at the mobile device 202—in this instance being located in an automobile—can be useful in preventing the visual indicator mechanism 105 from being a distraction to automobiles on the road. Other various types of triggering conditions at the mobile device 202 can similarly be used to cause a signal to be sent from the mobile device 202 to the earbud device 101, 102 to cause the visual indicator mechanism 105 to be temporarily disabled (e.g., for the duration of the presence of the triggering condition at the mobile device 202).

Figure 3:
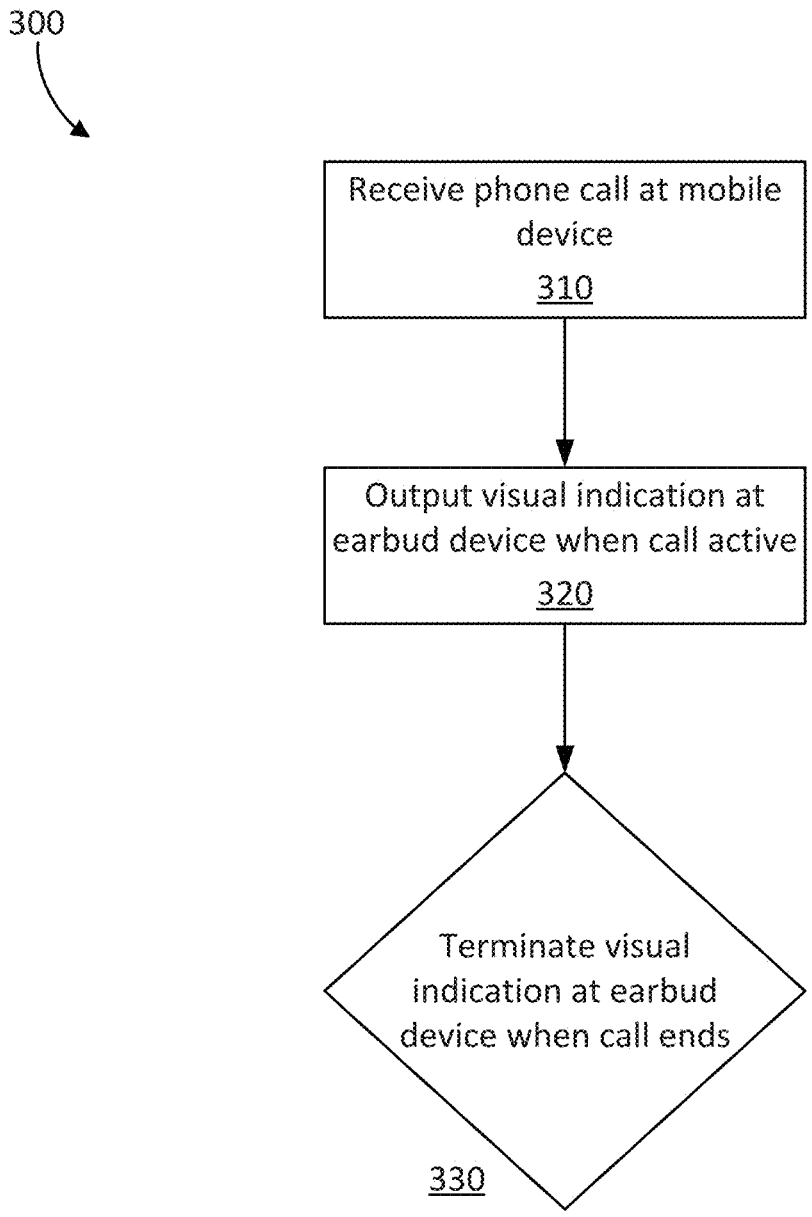
FIG. 3 is a flow diagram of an embodiment of a method of using an earbud device, in accordance with one or more embodiments described herein.

FIG. 3 depicts a flow diagram of an embodiment of a method 300 of using an earbud device. In some examples, the method 300 can include (e.g., use) any one or more of the features disclosed previously herein with respect to the earbud device 101, 102 and/or the mobile device 202.

At step 310, the method 300 includes receiving a phone call at a mobile device. The mobile device can be, for example, a mobile phone or other type of mobile computing device that is capable of playing audio and transmitting audio to a remote device. The mobile device can be in audio signal communication (e.g., wireless communication, such as Bluetooth) with at least one earbud device (e.g., with a pair of earbud devices), such as the earbud device 101, 102 described elsewhere herein.

At step 320, the method 300 includes, when the phone call is active at the mobile device, outputting a first visual indication at a visual indicator mechanism that is included at a body of an earbud device. As noted, the earbud device can be in audio signal communication with the mobile device, and the earbud device can include a body that has a visual indicator mechanism configured to output one or more visual indications, including the first visual indication that the earbud device is configured to output when the phone call is active at the mobile device. The first visual indication output from the visual indicator mechanism can be a preset visual indication that can include one or more types of light states, such as one or more different colors and/or one or more different light emission patterns. In this embodiment, the first visual indication can be preset as corresponding to earbud device use for phone call audio.

At step 330, the method 300 includes, when the phone call ends at the mobile device, terminating the first visual indication at the visual indication mechanism at the earbud device. In executing the method 300, including outputting the first visual indication at the visual indication mechanism at the earbud device when the phone call is active at the linked mobile device, at step 320, and terminating the first visual indication at the visual indication mechanism at the earbud device when the phone call ends at the linked mobile device, an observer of the earbud device wearer can visually discern that the earbud wearer is on a phone call and it may not be an ideal time to interrupt the earbud wearer.

In an additional embodiment, the method 300 could further include a step of, when the earbud device is receiving non-phone call audio from the mobile device, outputting a second, different visual indication at the visual indicator mechanism that is included at a body of an earbud device. The first visual indication and the second, different visual indication can include different light states selected from the group consisting of: a first color; a second, different color; a first light pattern; and a second, different light pattern. Like the first visual indication can be preset as corresponding to earbud device use for phone call audio, the second visual indication can be preset as corresponding to earbud use for non-phone call audio—a different audio use of the earbud device than the use of the earbud device corresponding to the first visual indication. In this way, the output of different visual indications at the earbud device corresponding to different audio uses of the earbud device can convey a visual cue to an observer of the earbud device wearer as to a type of current use of the earbud device and, thus, better inform the observer as to whether to interrupt the earbud device wearer.

In another, additional embodiment, the method 300 could further include a step of, when the earbud device is in audio signal communication with the mobile device and the earbud device is separated from the mobile device by more than a predetermined distance, outputting an earbud device separation alert at the mobile device. For instance, programmable processing circuitry (e.g., a programmable processor) at the mobile device could execute computer-executable instructions, stored at the mobile device, to cause the programmable processing circuitry to monitor (e.g., at preset, periodic intervals) a general distance between the mobile device and the earbud device, such as using a wireless signal (e.g., Bluetooth) strength between the mobile device and the earbud device. Then, when the programmable processing circuitry determines that the earbud device is separated from the mobile device by more than the predetermined distance, the programmable processing circuitry can cause the mobile device to output the earbud device separation alert. Outputting the earbud device separation alert at the mobile device can be useful, for example, in alerting a user as to a potential misplaced earbud device (e.g., an earbud device that fell out of the user's ear).

In another embodiment, the method 300 could further include a step of, when the earbud device is in audio signal communication with the mobile device and the earbud device loses audio signal communication with the mobile device, outputting an earbud device separation alert at the earbud device. For instance, programmable processing circuitry (e.g., a programmable processor) at the earbud device could execute computer-executable instructions, stored at the earbud device, to cause the programmable processing circuitry at the earbud device to monitor (e.g., at preset, periodic intervals) for the presence of an audio signal communication (e.g., Bluetooth connection) between the earbud device and the mobile device. Then, when the programmable processing circuitry at the earbud device determines that the earbud device has lost the audio signal communication with the mobile device, the programmable processing circuitry at the earbud device can cause the earbud device to output the loss of mobile device signal communication indication, for instance at the indicator mechanism (e.g., a visual indication). Outputting the loss of mobile device signal communication indication at the earbud device can be useful, for example, in alerting as to a loss of audio signal communication between the earbud device and the mobile device.

In yet another, additional embodiment, the method 300 could further include a step of, when the mobile device is receiving the phone call but the phone call is not yet active at the mobile device, outputting a second, different visual indication at the visual indicator mechanism that is included at a body of an earbud device. The second visual indication can be output at the visual indicator mechanism when: (i) the mobile device is receiving the phone call but the phone call is not yet active at the mobile device, and (ii) the mobile device and the earbud device are in signal communication (and thus the mobile device may not output an incoming phone call audio ring independent of audio output at the earbud device). The second visual indication output at the visual indicator mechanism when the mobile device is receiving the phone call but the phone call is not yet active at the mobile device can be different than the first visual indication output at the visual indicator mechanism when the phone call is active at the mobile device. This differential visual indication output at the earbud device when the mobile device is receiving a phone call can be useful in helping to draw a user's attention to the fact that a phone call is incoming at the mobile device even though the user may not be wearing the earbud device at that time and, thus, wouldn't benefit from audio output at the earbud device indicating that a phone call is incoming.

Various examples of the disclosure have been described. Any combination of the described systems, operations, or functions is contemplated.

What is claimed is:

1. An earbud device comprising:

a body;

processing circuitry at the body;

a receiver at the body and coupled to the processing circuitry, the receiver configured to receive an audio signal from a mobile device;

a speaker at the body and coupled to the processing circuitry, the speaker configured to output audio at the earbud device corresponding to the audio signal from the mobile device; and a visual indicator mechanism at the body and coupled to the processing circuitry, wherein the visual indicator mechanism is configured to output at least one visual indication at least when the earbud device is receiving the audio signal from the mobile device, wherein the visual indicator mechanism is configured to output a first visual indication, at the visual indicator mechanism, corresponding to a first preset earbud use type, wherein the first preset earbud use type comprises receiving the audio signal from the mobile device, and wherein the visual indicator mechanism is configured to output a second, different visual indication, at the visual indicator mechanism, corresponding to a second, different preset earbud use type, wherein the first preset earbud use type is selected from the group consisting of: incoming phone call; on an active phone call; non-phone call audio playing; and inactive earbud, wherein the second preset earbud use type is another, different selection from the group consisting of: incoming phone call; on an active phone call; non-phone call audio playing; and inactive earbud, wherein the first visual indication output from the visual indicator mechanism is selected from the group consisting of: a first color; a second different color; a first light emission pattern;

and a second different light emission pattern.

2. The earbud device of claim 1, wherein the first preset earbud use type comprises use of the earbud device for an active phone call via the mobile device, and wherein the second preset earbud use type comprises at least one of: an audio inactive earbud and use of the earbud device for non-phone call audio playing.

3. The earbud device of claim 1, wherein the second visual indication output from the visual indicator mechanism is another, different selection from the group consisting of: a first color; a second different color; a first light emission pattern; and a second different light emission pattern.

4. The earbud device of claim 1, wherein the first visual indication output from the visual indicator mechanism is a first color at a first light emission pattern, and wherein the second visual indication output from the visual indicator mechanism is a second, different color at a second, different light emission pattern.

5. The earbud device of claim 1, wherein the first visual indication output from the visual indicator mechanism is a first light emission pattern, and wherein the second visual indication output from the visual indicator mechanism is a second, different light emission pattern.

6. The earbud device of claim 1, wherein the first visual indication output from the visual indicator mechanism is one of a first color and a second different color, and wherein the second visual indication output from the visual indicator mechanism is one of a first light emission pattern and a second, different light emission pattern.

7. The earbud device of claim 1, wherein the first visual indication comprises at least one of a first color and a first light emission pattern and the first preset earbud use type comprises use of the earbud device for an active phone call via the mobile device, and wherein the second visual indication comprises at least one of a second, different color and a second, different light emission pattern and the second preset earbud use type is selected from the group consisting of: an incoming phone call; non-phone call audio playing; and inactive earbud.

8. The earbud device of claim 1, wherein the receiver is included as part of a wireless transceiver at the earbud device.

9. The earbud device of claim 1, wherein the receiver is configured to receive an audio signal from a mobile device when the earbud device is in signal communication with the mobile device, and wherein the visual indictor mechanism is configured to change the at least one visual indication output at the visual indicator mechanism when the receiver receives the audio signal from the mobile device.

10. The earbud device of claim 9, wherein the speaker is configured to output audio at the earbud device corresponding to the received audio signal from the mobile device, and wherein the visual indictor mechanism is configured to maintain the at least one visual indication output at the visual indicator mechanism when the speaker outputs the audio signal from the mobile device.

11. An earbud device comprising:

a body;

processing circuitry at the body;

a receiver at the body and coupled to the processing circuitry, the receiver configured to receive an audio signal from a mobile device;

a speaker at the body and coupled to the processing circuitry, the speaker configured to output audio at the earbud device corresponding to the audio signal from the mobile device; and a visual indicator mechanism at the body and coupled to the processing circuitry, wherein the visual indicator mechanism is configured to output at least one visual indication at least when the earbud device is receiving the audio signal from the mobile device, wherein the visual indicator mechanism is configured to output a first visual indication, at the visual indicator mechanism, corresponding to a first preset earbud use type, wherein the first preset earbud use type comprises receiving the audio signal from the mobile device, and wherein the visual indicator mechanism is configured to output a second, different visual indication, at the visual indicator mechanism, corresponding to a second, different preset earbud use type, wherein the first preset earbud use type comprises use of the earbud device for an active phone call via the mobile device, and wherein the second preset earbud use type comprises at least one of: an audio inactive earbud and use of the earbud device for non-phone call audio playing, wherein the earbud device is configured to receive, at the receiver, an enabled/disabled signal from the mobile device in communication with the receiver, and wherein, in response to receiving the enabled/disabled signal from the mobile device, the processing circuitry of the earbud device is configured to correspondingly enable/disable the visual indicator mechanism at the earbud device.

12. The earbud device of claim 11, wherein the receiver is configured to receive an audio signal from a mobile device when the earbud device is in signal communication with the mobile device, and wherein the visual indictor mechanism is configured to change the at least one visual indication output at the visual indicator mechanism when the receiver receives the audio signal from the mobile device.

13. The earbud device of claim 12, the speaker is configured to output audio at the earbud device corresponding to the received audio signal from the mobile device, and wherein the visual indictor mechanism is configured to maintain the at least one visual indication output at the visual indicator mechanism when the speaker outputs the audio signal from the mobile device.

14. The earbud device of claim 11, wherein the first visual indication output from the visual indicator mechanism is selected from the group consisting of: a first color; a second different color; a first light emission pattern; and a second different light emission pattern.

15. A method comprising the steps of:

receiving a phone call at a mobile device;

when the phone call is active at the mobile device, outputting a first visual indication at a visual indicator mechanism that is included at a body of an earbud device, the earbud device being in audio signal communication with the mobile device;

when the phone call ends at the mobile device, terminating the first visual indication at the visual indication mechanism at the earbud device; and when the earbud device is receiving non-phone call audio from the mobile device, outputting a second, different visual indication at the visual indicator mechanism that is included at a body of an earbud device, wherein the first visual indication and the second, different visual indication comprise different light states selected from the group consisting of: a first color; a second, different color; a first light pattern; and a second, different light pattern.

16. The method of claim 15, further comprising the step of:

when the earbud device is in audio signal communication with the mobile device and the earbud device is separated from the mobile device by more than a predetermined distance, outputting an earbud device separation alert at the mobile device.

17. The method of claim 15, further comprising the step of:

when the mobile device is receiving the phone call but the phone call is not yet active at the mobile device, outputting the second, different visual indication at the visual indicator mechanism that is included at a body of an earbud device.

* * * * *